United States Patent [19]

Onishi et al.

[11] 4,031,869

[45] June 28, 1977

[54] IGNITION-TIMING ADJUSTING SYSTEM FOR SPARK-IGNITION INTERNAL COMBUSTION ENGINES

[75] Inventors: Takanori Onishi; Ken Shiozawa, both of Toyota, Japan

[73] Assignee: Toyota Jidosha Kogyo Kabushiki Kaisha, Japan

[22] Filed: Jan. 20, 1975

[21] Appl. No.: 542,448

[30] Foreign Application Priority Data

Feb. 18, 1974 Japan ..... 49-018475

[52] U.S. Cl. ..... 123/117 A; 123/136

[51] Int. Cl.[2] ..... F02P 5/04

[58] Field of Search ..... 123/117 A, 136

[56] References Cited

UNITED STATES PATENTS

| | | | |
|---|---|---|---|
| 2,650,581 | 9/1953 | Short et al. | 123/117 A |
| 2,702,028 | 2/1955 | Gintling | 123/117 A |
| 3,515,108 | 6/1970 | Deeter et al. | 123/136 |
| 3,521,609 | 7/1970 | Kashiwagi et al. | 123/117 A |
| 3,678,907 | 7/1972 | Vartanian | 123/117 A |
| 3,779,218 | 12/1973 | Nambu | 123/117 A |
| 3,800,767 | 4/1974 | Winkley | 123/117 A X |

*Primary Examiner*—C. J. Husar
*Assistant Examiner*—Tony M. Argenbright
*Attorney, Agent, or Firm*—Kenyon & Kenyon

[57] ABSTRACT

This discloses an ignition-timing adjusting system for internal combustion engines, which realizes an advance of the ignition-timing relating to the temperature of an engine. This system comprises vacuum advance means responsive to a vacuum produced by the vacuum in the intake tube of the engine for advancing the ignition timing of the engine, and means for controlling the level of said vacuum produced by said intake-tube vacuum with relation to the temperature of the engine. When the engine is cold, the ignition-timing is advanced under control of said vacuum-level controlling means to the proper position for operation of the cold engine.

8 Claims, 7 Drawing Figures

IGNITION-TIMING ADJUSTING SYSTEM FOR SPARK-IGNITION INTERNAL COMBUSTION ENGINES

BACKGROUND OF THE INVENTION

1. Field of the Invention

The present invention relates to an ignition-timing adjusting system for an internal combustion engine, and more particularly, to a system for realizing the proper advance of the ignition-timing (or spark-timing) of an engine during operation when the engine is cold.

It is well-known that the ignition-timing of a conventional spark-ignition engine should be varied for different operating conditions in order to ensure the most effective and smooth operation. Specifically, in a spark-ignition engine for automobiles, for example, the normal ignition-timing is generally preset so that an effective and smooth operation can be achieved when the engine is idling and is warm. Accordingly, at higher speeds, or under a part-load (or part-open throttle) operating condition or when the engine is cold, the ignition should be advanced.

Particularly, it is well-known that the proper advance of the ignition-timing during operation of a cold engine provides an increase in the out-put power and a large improvement in fuel-consumption, and enhances engine response and performance. Further, there is a decrease in the quantity of harmful constituents contained in the exhaust gas.

2. Description of the Prior Art

The advance of the ignition-timing relating to the engine-speed and/or the engine-load condition is achieved by employing a centrifugal advance mechanism and/or a vacuum advance mechanism, respectively, which are both well-known.

In order to realize said advance of the ignition-timing with relation to the engine-temperature, an electrical advance system is generally used. A conventional electrical system includes two or more sets of breaker points in the distributor, an electrical switch responsive to the engine-temperature, and a relay for selecting one of said sets of breaker points. This system operates electrically in such a manner that any one set of breaker points, which provides the proper ignition-timing advance, is selected according to the engine-temperature.

However, said electrical advance system has many disadvantages. That is, the electrical elements for the selecting of the breaker points are very expensive, and service and maintenance thereof are hard to obtain because adjusting or repairing of two or more sets of breaker points is very difficult and time consuming.

SUMMARY OF THE INVENTION

It is, therefore, a primary object of the present invention to provide a novel and improved system for adjusting the ignition-timing with relation to the engine-temperature, which does not have the disadvantages of said conventional system.

Another object of the present invention is to provide a mechanical system for realizing the proper ignition-timing during operation when the engine is cold, which is inexpensive, has a high level of reliability in operation and is easy to service and maintain.

A further object of the present invention is to provide a vacuum-type ignitiontiming advance system, which realizes the advance ignition-timing with relation to both the engine-temperature and the load conditions of the engine.

It is a still further object of the present invention to provide an ignition-timing advance system which can be used with a fuel-evaporation purge system.

These and other objects have been achieved by the system, according to the present invention, which comprises vacuum advance means attached to the distributor of the engine and responsive to a vacuum produced by the vacuum in the intake tube of the engine for advancing the ignition-timing, and means for controlling the level of said vacuum produced by said intake-tube vacuum with relation to the temperature of the engine.

In a preferable embodiment, said vacuum advance means includes a vacuum actuator connected to a breaker plate of the distributor of the engine. The vacuum chamber of said actuator is connected by a vacuum line to a vacuum port in the intake tube, and is also connected by an atmospheric line to the atmosphere. Said vacuum-level controlling means includes a one-way valve arranged along said vacuum line and a temperature-responsive valve arranged along said atmospheric line. Said one-way valve opens said vacuum line when the level of said intake-tube vacuum is higher than that of the actuator-chamber vacuum and closes the same when the former level is lower than the latter. The temperature-responsive valve opens and closes said atmospheric line when the engine is warm and cold, respectively.

During operation when the engine is cold, since said temperature-responsive valve is closed, a vacuum having the same level as that the vacuum in the intake tube is produced in the vacuum chamber of the actuator. This vacuum causes the vacuum actuator to rotate the breaker plate, and thereby realizes the advance of the ignition-timing.

The one-way valve functions to maintain the level of said vacuum, which is produced in the vacuum chamber, even if the level of the intake-tube vacuum is lowered, due to a change in the operating conditions, so that the advanced ignition-timing can be maintained while the engine is cold.

Preferably, the atmospheric line communicates with the ambient atmosphere through a canister for a fuel-evaporation purge system. In this construction, the purge flow is not supplied when the engine is cold, which improves the operation of said cold engine in comparison with an engine employing a conventional purge system. The above-mentioned and other objects, features, and advantages of the present invention will be more apparent from the following description of the preferable embodiments of the invention, with reference to the accompanying drawings.

DETAILED DESCRIPTION OF THE PREFERRED EMBODIMENTS

Figure 1:
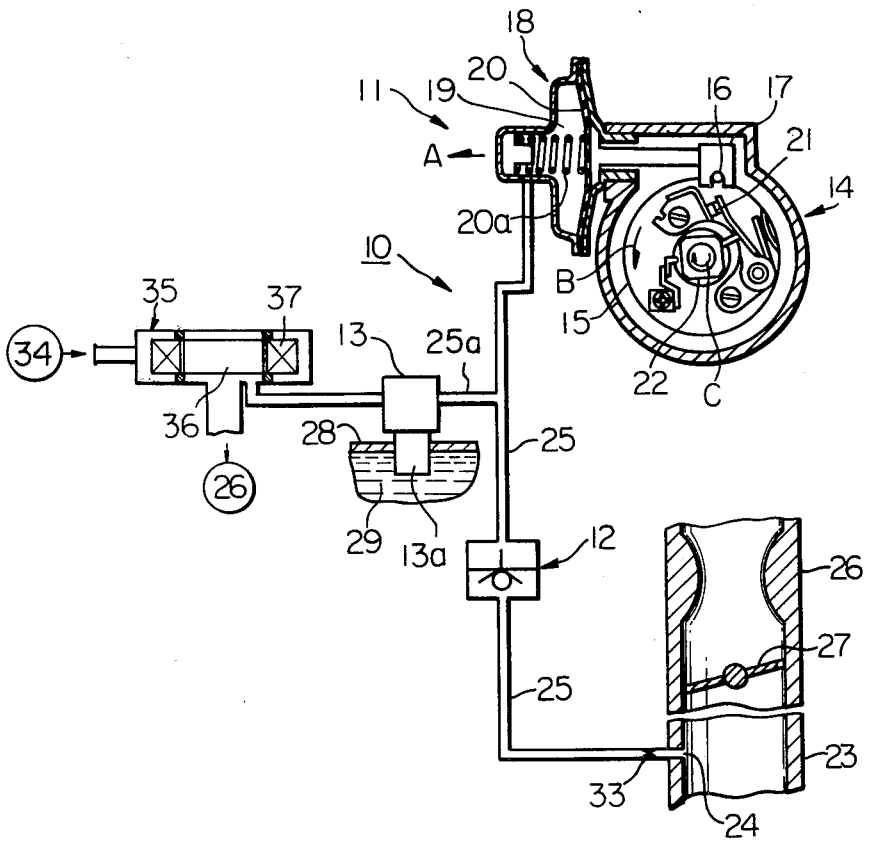
FIG. 1 diagramatically illustrates an ignition-timing system according to the present invention.

Referring to the Figures, FIG. 1 illustrates a system for realizing the advance of the ignition-timing with relation to only the temperature of the engine. This system, indicated generally by numeral 10, includes a vacuum advance mechanism 11, and a vacuum controllng means including a one-way valve (or check valve) 12 and a temperature-responsive valve 13.

The vacuum advance mechanism 11 has basically the same arrangement and function as those of a well-known vacuum advance mechanism. This mechanism 11 includes a vacuum actuator 18, which has a spring-loaded diaphragm 20. This diaphram is connected, by means of a rod 17 and a pin 16, to a rotatable breaker plate 15 in a contact-point type distributor 14. When a vacuum is present in the airtight chamber or diaphragm chamber 19 of the actuator 18, the diaphragm 20 and the rod 17 are moved by the pressure difference between said vacuum and the atmospheric pressure against a return spring 20*a* in the direction of arrow A. This movement causes the breaker plate 15 to rotate in the direction of arrow B. This rotation carries breaker points 21 on the breaker plate 15 around a breaker cam 22 which rotates in the direction of arrow C, so that the cam 22 opens and closes the points 21 earlier in the rotating cycle of the cam, whereby the ignition-timing is advanced.

The diaphragm chamber 19 of the actuator 18 is connected by a vacuum line 25 to a vacuum port 24 in the intake tube 23. The port 24 is preferably located relatively downstream from a throttle valve 27 in the intake tube 23 so that a partial vacuum is always produced in the region adjacent to the port 24, when the engine is running. The diaphragm chamber 19 is also connected by an atmospheric line 25*a*, which branches off the vacuum line 25, to a cleanair chamber 36 of an aircleaner 35, and thus, can communicate through the cleaner element 37 with the ambient atmosphere 34.

The one-way valve 12 is arranged along the vacuum line 25 between the intake tube and the diverging point of the atmospheric line 25*a*. This valve 12 is a well-known check valve which allows the fluid to flow therethrough in one direction, but not in the reverse direction. The oneway valve 12 is positioned so as to allow the air in the vacuum line 25 to flow therethrough only from one side of the diaphragm chamber 19 to the other side of the intake tube 23. Therefore, when the level of the vacuum in the intake tube 23 is higher than that of the vacuum in the diaphragm chamber 19, the air in the diaphragm chamber 19 is sucked through the one-way valve 12 into the intake tube 23, whereby a vacuum having the same level as that of the intake-tube vacuum is produced in the diaphragm. On the other hand, when the level of the intake-tube vacuum is equal to or lower than that of the diaphragm-chamber vacuum, for example, at lower speeds or under a wide-open throttle condition, the valve 12 closes, whereby the level of the vacuum in the diaphragm chamber 19 can be maintained. This function of the oneway valve 12, therefore, ensures that the vacuum having a level which is equal to the highest level of the intake-tube vacuum is produced in the diaphragm chamber 19, and is maintained or locked therein while the engine is cold, as will be mentioned later.

The temperature-responsive valve 13 is arranged along the atmospheric line 25*a*. This valve 13 is also well-known and responds to the engine-temperature and opens only when said temperature is higher than a preset one. The valve 13 has a temperature sensor 13*a* which is provided with, for example, a bimetalic or wax temperature sensing element (not shown). The temperature sensor 13*a* is inserted through the water jacket 28 of the engine into the engine-cooling water 29, so as to sense the temperature of said water 29. When the temperature of said engine-cooling water 29 is lower than the preset one, that is, when the engine is cold, the valve 13 closes the atmospheric line 25*a*, but opens it again after the engine warms up. Therefore, the vacuum line 25 and the diaphragm chamber 19 of the actuator 18 are isolated from the atmosphere 34 when the engine is cold, but are in communication with the atmosphere when the engine is warm. This function of said valve 13 ensures that a vacuum is produced in the diaphragm chamber 19 by the intake vacuum in the intake tube 23 when the engine is cold, but is not produced when the engine is warm.

It should be noted that there is preferably a vacuum restrainer 33, which is interposed in the vacuum line 25 between the vacuum port 24 and the one-way valve 12. This restrainer 33 functions to restrain the amount of air flowing therethrough from the vacuum line 25 into the intake tube 23, in order to prevent a large quantity of air being sucked at one time into the intake tube 23 when the atmospheric line 25*a* is opened by the valve 13. If a large quantity of air flows into the intake tube 23, th air-fuel ratio of the mixture to be supplied to the engine becomes improperly lean. Said restrainer 33 also ensures that the diaphragm chamber 19 is subject to atmospheric pressure when the atmospheric line 25*a* is opened, whereby, as will be mentioned later, the vacuum advance mechanism 11 is returned to its normal position, that is, the position of no-advance of the ignition-timing when the engine warms up.

Said system 10 operates as follows. When the engine is started, a partial vacuum is produced in the intake tube 23 downstream from the throttle valve 27. When the engine is cold; since the temperature-responsive valve 13 closes the atmospheric line 25*a*, said intake-tube vacuum sucks the air from both the vacuum line 25 and the diaphragm 19 into the intake tube 23, through the one-way valve 12 and restrainer 33. This produces a vacuum having a level equal to that of the intake-tube vacuum in the region adjacent to the port 24. The vacuum in the diaphram chamber 19 causes the diaphram 20 and the rod 17 to move in the direction A, and, in turn, the breaker plate 15 to rotate in the direction B. As a result, as described hereinbefore, the ignition-timing is advanced to the proper position for the operation of a cold engine. Since the level of the vacuum in the diaphram chamber 19 is maintained even if the level of the intake-tube vacuum is lowered, for example, under a wide-open throttle (or full-load) operating condition, said proper advance of the ignition-timing can be maintained while the engine is cold.

When the engine warms up above the predetermined temperature for which said advance of the ignition-timing is not necessary, since the temperature-responsive valve 13 opens the pressure line 25*a*, the atmosphere 34 enters into both the vacuum line 25 and the diaphragm chamber 19. Accordingly, the return spring 20*a* causes the diaphragm 20 and, thus, the breaker plate 15 to return to their normal positions. Thus, the ignition-timing returns to its no-advanced position.

As mentioned above, when the engine is cold, the advance of ignition-timing is realized with relation to the engine-temperature regardless of the other operating conditions. This advance provides many advantages, such as an increase in the out-put power, an improvement in fuel-consumption, and clean exhaust gas, and enhances engine response and performance.

Figure 2:
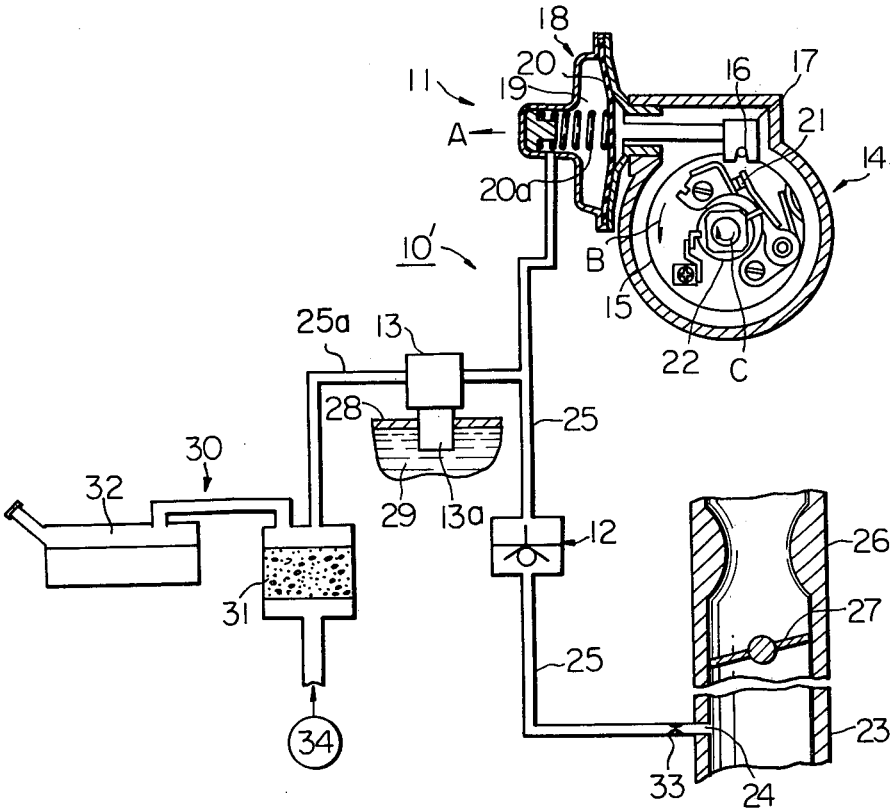
FIG. 2 shows a variation of embodiment shown in FIG. 1.

FIG. 2 illustrates a system 10', which is a variation of the system 10 of FIG. 1. This system 10' is substantially the same in construction and function as the system 10 mentioned above. The difference therebetween is that the atmospheric line 25 is connected to a canister 31 of a fuel evaporation purge system 30. This purge system is well-known for preventing fuel evaporation from the fuel tank into the atmosphere. When the engine is not running, fuel evaporation from the fuel tank 32 is absorbed by activated charcoal within the canister 31. The absorbed fuel is, as the engine starts, carried into the intake tube via a purge line by air passing through the canister 31 from the atmosphere 34.

However, in an engine employing a conventional purge system, the purge flow containing the fuel is supplied into the engine while the engine is running, regardless of the engine-temperature. This causes a change in the air-fuel ratio of the mixture to be supplied to the engine. This is disadvantageous to the operation of the engine, particularly when the engine is cold.

This problem can be easily solved by utilizing the ignition-timing advance system according to the present invention. In the system 10', the atmospheric line **25*a* serves as the purge line. Therefore, the purge flow can enter the intake tube 23, when the engine is warm, because the atmospheric line 25*a* is open, but can not enter when the engine is cold, because the atmospheric line 25*a*** is closed.

Figure 3:
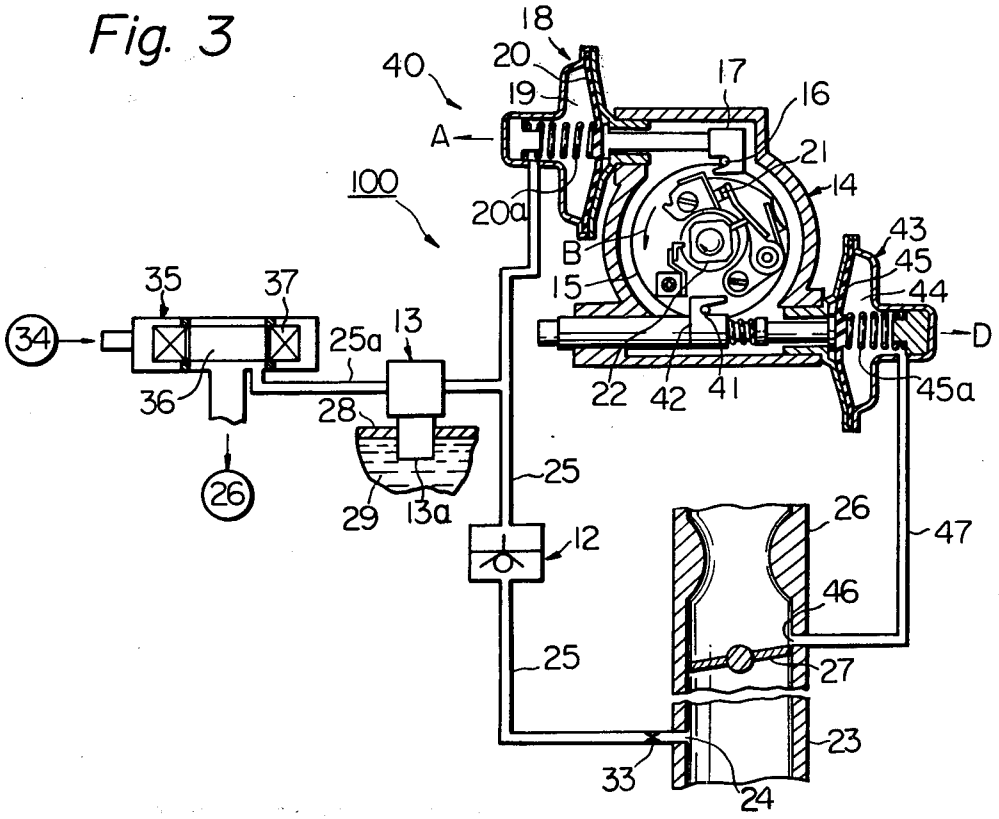
FIG. 3 illustrates another embodiment of the present invention.

FIG. 3 illustrates a system for realizing the advance of the ignition-timing with relation to the temperature of the engine, and also according to the load conditions when the engine is warm. This system 100 includes a vacuum advance mechanism 40, and the same vacuum-level controlling means including the one-way valve 12 and the temperature-responsive valve 13 as the one described hereinbefore with reference to FIG. 1. The vacuum advance mechanism 40 includes first and second vacuum actuators 18 and 43.

It should be noted that the functions of and the fluid connections between the first actuator 18, the one-way valve 12, and the temperature-responsive valve 13 are the same as the system 10. Therefore, the following explanation for said system 100 is directed to the differences between this system and said system 10.

Said second vacuum actuator 43 has a spring-loaded diaphragm 45, which is connected by means of a rod 42 and a pin 41, to the before-mentioned breaker plate 15. The diaphragm chamber 44 of the actuator 43 is continuously in communication, via second vacuum line 47, with second vacuum port 46 in the carburetor 26. The second port 46 is located just above the throttle valve 27 when the latter is closed, so that a vacuum having a level relating to the opening condition of the throttle valve 27 is produced in the diaphragm chamber 44 of the second actuator by the vacuum from the second port 46.

Said vacuum produced in the diaphragm chamber 44 causes the diaphragm 45 and the rod 42 to move against the return spring **45*a* in the direction of arrow D. This movement causes the breaker plate 15 to rotate in the direction of arrow B, thereby causing the advance of the ignition-timing. The angle of said advance of the ignition-timing is in proportion to the level of the vacuum in the diaphragm chamber 44, which level is related to the opening condition of the throttle valve 27**, that is, the load condition of the engine.

The system 100 operates as follows. When the engine is running, a partial vacuum is in the intake tube 23. Particularly, in the region adjacent to the second port 46, a vacuum having a level relating to the opening condition of the throttle valve 27 is produced. The latter vacuum produces the above-mentioned level of vacuum in the diaphragm chamber 44 of the second actuator 43, via the second port 46 and the second vacuum line 47.

When the engine is cold, since the temperature-responsive valve 13 closes the atmospheric line **25*a*, the vacuum having a level equal to the highest level of the intake tube vacuum in the region adjacent to the port 24 is produced in the vacuum chamber 19 of the first actuator, and this level is maintained while the engine is cold, as before-described. The vacuums which are produced in the first actuator 18 and the second actuator 43, respectively, cause the breaker plate 15 to rotate. Therefore, the position of the breaker plate 15 is determined by whichever one of said actuators is providing the greater movement at the time. However, the rotating angle of the breaker plate 15 is never smaller than the rotating angle determined by the first actuator 18** when the engine is cold. That is, during operation when the engine is cold, the ignition-timing is advanced to and maintained in a proper position for cold operation.

When the engine is warm, the temperature-responsive valve 13 opens the atmospheric line **25*a*, and the diaphragm 20 of the first actuator is returned to and held in its normal position by the return spring 20*a* in the manner before-mentioned, and ceases to function. Accordingly, during the operation when the engine is warm and after the first actuator 18 ceases to function, the position of the breaker plate 15 is determined by the second actuator 43, alone, and thus the ignition-timing is advanced with relation to the opening condition of the throttle valve 27**, that is, the load condition of the engine.

Preferably, the vacuum advance mechanism 40 is so constructed that the rotational movement of the breaker plate 15 in direction B by either one of the actuators is not prevented by the other. In the embodiment, the connecting rods 17 and 42 of the first and second actuators 18 and 43 are constructed as shown in FIG. 3, so that either one of the pins 16 and 41 secured to the breaker plate 15 can be disengaged from the corresponding rods 17 and 42 in the direction B, when the breaker plate 15 is rotated by the other rods.

Figure 4:
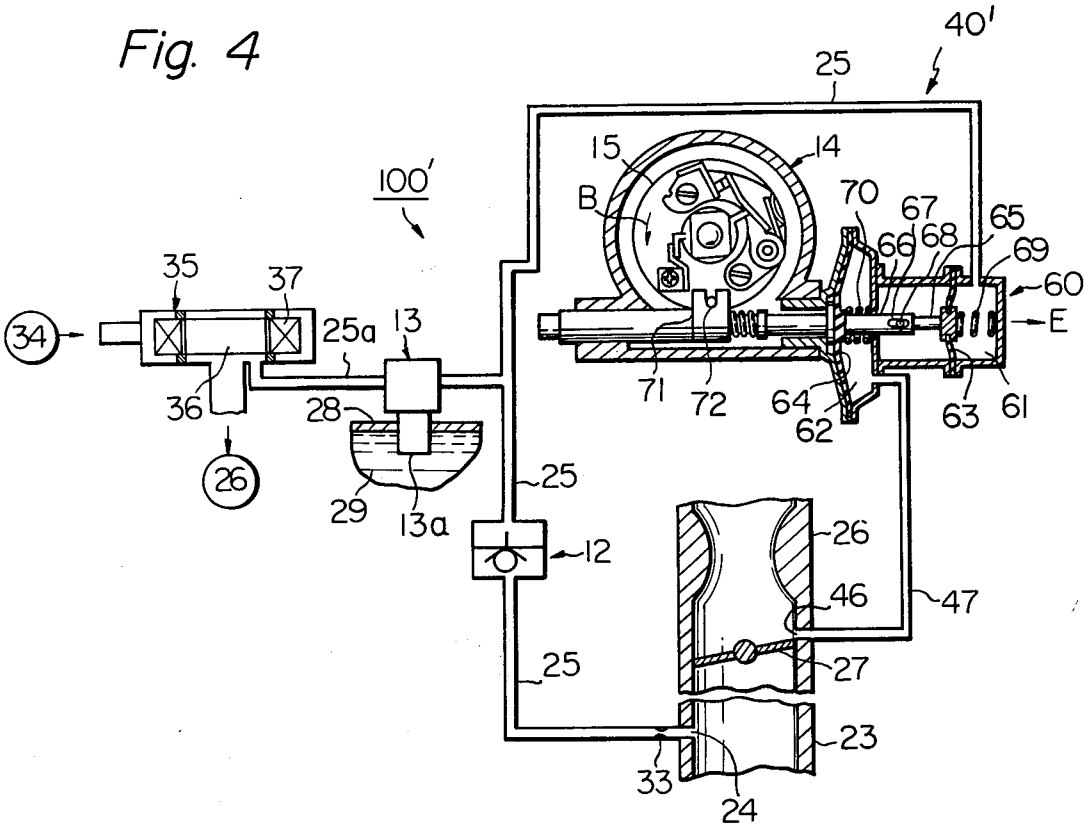
FIGS. 4 and 6 show variations of the embodiment shown in FIG. 3.

The system 100' shown in FIG. 4 is a variation of the system 100 shown in FIG. 3. This system 100' has the same function as that of said system 100, although the vacuum advance mechanism is slightly different. In the system 100, the advance mechanism 40 has two independent vacuum actuators 18 and 43, which make the system expensive, and increase the probability of mechanical trouble in the vacuum actuator.

In the system 100', on the other hand, the vacuum mechanism 40' utilizes a single vacuum unit 60, which has a construction such that two vacuum actuators are tandemly connected to each other. This vacuum unit 60 has first and second vacuum chambers 61 and 62, and first and second spring-loaded diaphragm 63 and 64. These diaphragms 63 and 64 are secured to the first and second rods 65 and 66, respectively. Said first rod 65 is connected to the second rod 66 by means of a slot 67 and a pin 68 for the axial relative movement of said rods. The second rod 66 is, in turn, connected to the breaker plate 15 by means of a connecting rod 71 and a pin 72. Said diaphragms 63 and 64 are normally biased by return springs 69 and 70 toward the left in FIG. 4. When a vacuum is present in either one or both of the diaphragm chambers 61 and 62, the corresponding diaphragms 63 and/or 64 are moved against the return spring 69 and/or 70 in the direction of arrow E, and cause the breaker plate 15 to rotate in the direction B. The position of the breaker plate 15 is determined by whichever one of the diaphragms is providing greater movement of the rod 71 at that time.

The first and second diaphragm chambers 61 and 62 are connected to the first vacuum line 25 and second vacuum line 47, respectively. When the engine is cold, therefore, the vacuum produced in the first diaphragm chamber 61 causes the first diaphragm 63 to move in the direction E. This movement causes said first and second rods 65 and 66 and the connecting rod 71 to rotate the breaker plate 15, whereby the advance of ignition-timing is realized. The angle of this advance is never smaller than that which is achieved by the highest level of vacuum in the first diaphragm chamber 61, while the engine is cold. When the engine is warm, atmospheric pressure enters the first diaphragm chamber 61 in the manner before-mentioned. Accordingly, the advance of the ignition-timing is controlled by the second diaphragm 64, alone, with relation to the load condition of the engine.

Figure 5:
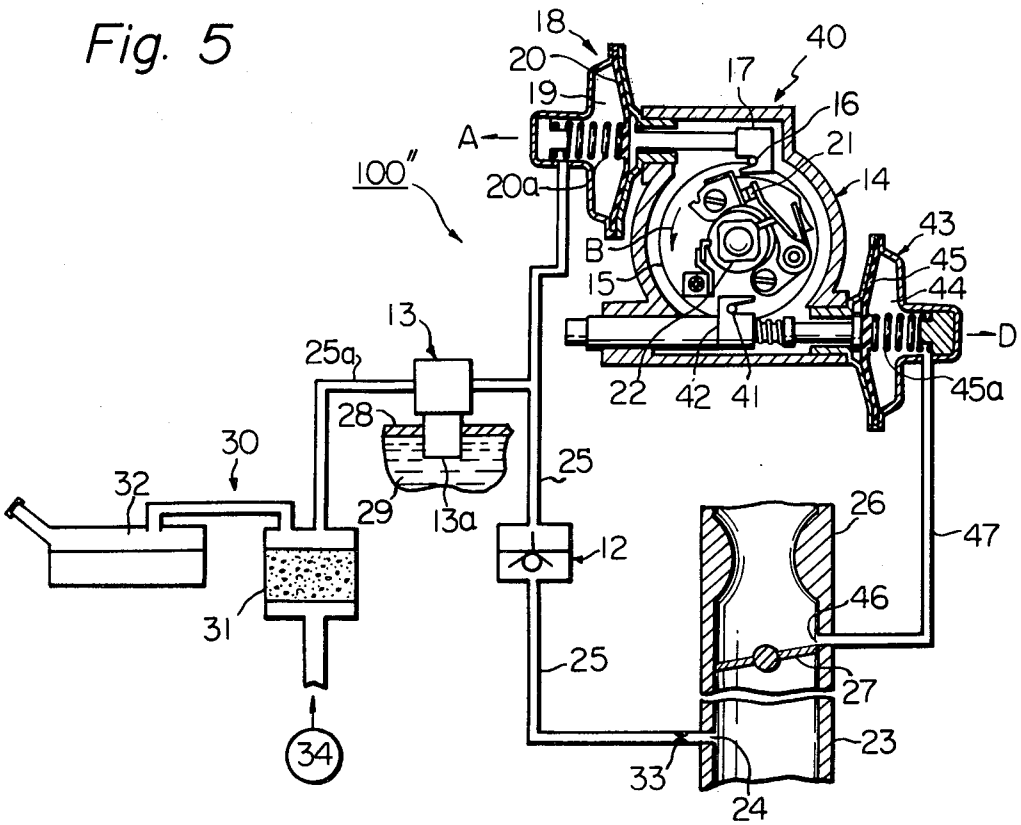
Figure 6:
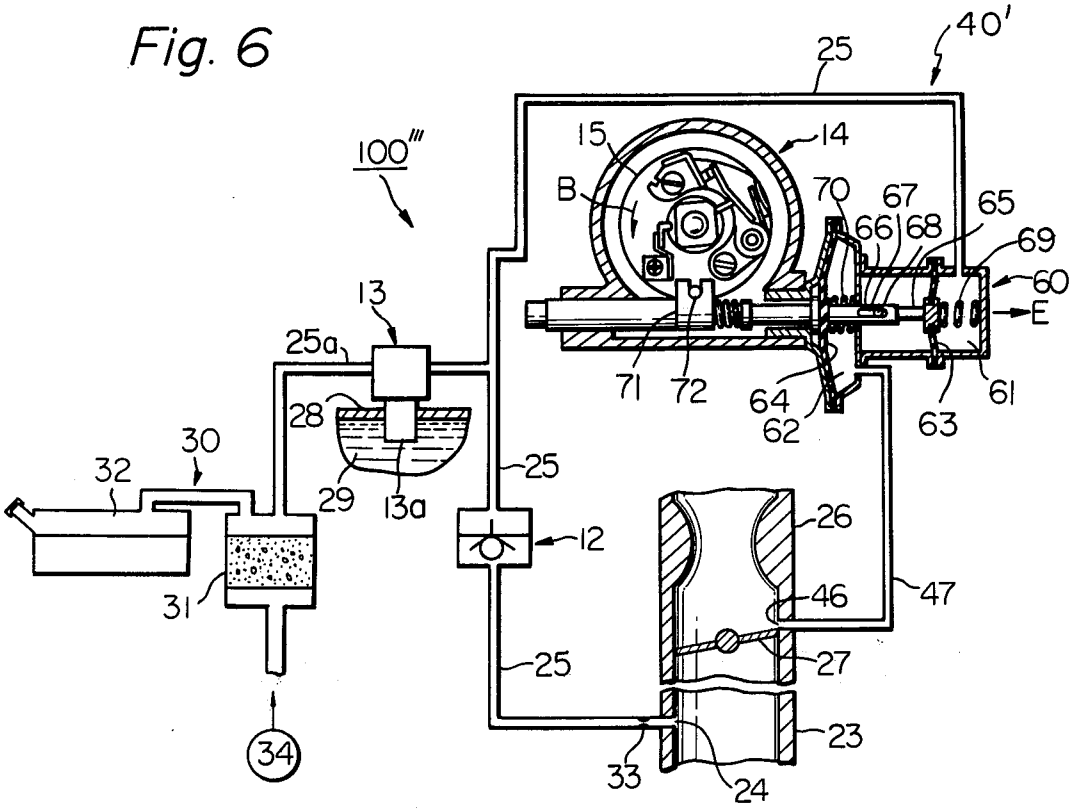

The systems 100'' and 100''', shown in FIGS. 5 and 6, are variations of the systems 100 and 100', described above, respectively. In these variations, the atmospheric line **25*a* communicates with the atmosphere 34 through the canister 31, as mentioned before. This, as described with reference to the system 10' shown in FIG. 2,** improves operation of the cold engine.

Figure 7:
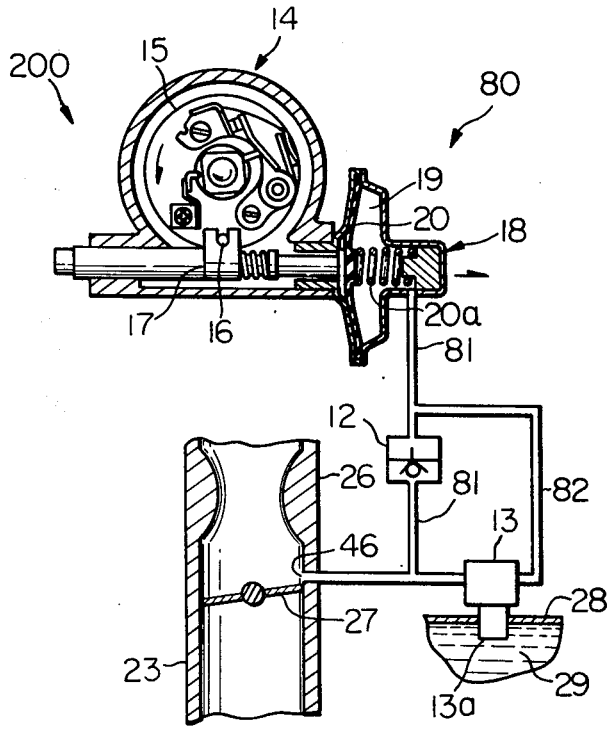
FIG. 7 illustrates a further embodiemtn of the present invention.

FIG. 7 shows a further system which, similar to said system 100 shown in FIG. 3, realizes the advance of the ignition-timing with relation to the engine-temperature, and also can control the advnace with relation to the load-condition of the engine when the engine is warm. This system 200, however, is similar in construction to said system 10 shown in FIG. 1, in the sense that it does not need two vacuum actuators to accomplish its above-mentioned function. That is, the system 200 includes a vacuum advance mechanism 80, and a vacuum-level controlling means including said one-way valve 12 and said temperature-responsive valve 13.

The vacuum advance mechanism 80 has a vacuum actuator 18, which is basically the same as the one shown in FIG. 1, although its diaphragm chamber 19 is connected to the vacuum port 46 by first and second vacuum lines 81 and 82. In FIG. 7, the second vacuum line 82 is illustrated as a bypass of the first vacuum line 81. The port 46 is, as mentioned before, located just above the throttle valve 27 when the latter is closed, so that a vacuum having a level relating to the opening condition of the throttle valve 27 is produced adjacent to the port 46.

The one-way valve 12 is arranged along said first vacuum line 81 between the inlet and the outlet of the second vacuum line 82. The valve 12 opens the first vacuum line 81 when the level of the vacuum in the region adjacent to the port 46 is higher than that of the vacuum in the diaphragm chamber 19, and closes it when said former level is equal to or lower than the latter. The connection of the temperature-responsive valve 13 is different from the systems shown in FIGS. 3 through 6. It is arranged along said second vacuum line 82, and closes it when the engine is cold, opening it when the engine is warm.

During operation when the engine is cold, since the temperature-responsive valve 13 closes the second vacuum line 82, the highest level of vacuum which has been produced in the diaphragm chamber 19 by the intake-tube vacuum in the region adjacent to the port 46 is maintained by the function of the one-way valve 12. This realizes the proper advance of the ignition-timing for cold operation. When the engine is warm, the valve 13 opens the second vacuum line 82, and the vacuum having a level relating to the opening condition of the throttle valve is produced in the diaphragm chamber 19. Then, the ignition-timing is controlled with relation to the opening condition of the throttle valve 27, that is, with relation to the load-condition of the engine.

It should be noted that, in order to realize the maximum angle of advance during the idling operation, it is necessary to open the throttle valve 27 a little so as to produce the highest level of vacuum in the diaphragm chamber 19. Because of this if the engine is idling, the throttle valve 27 is closed, only atmospheric pressure is introduced from the port 46 into the diaphragm chamber 19, since the port 46 is on the atmospheric pressure side when the throttle valve is closed.

As explained above, the basic function of the system 200 is similar to that of the systems shown in FIGS. 3 through 6. However, the system 200 has a weak point in that the maximum angle of advance is limited. Specifically, the systems shown in FIGS. 3 through 6, each have an exclusive vacuum actuator and vacuum line used for realizing the ignition-timing advance relating to the engine-temperature. Therefore, it is possible to freely select the angle of advance which is achieved by said exclusive actuator, so that the best ignition-timing can be realized. On the other hand, the angle of advance achieved by the system 200 is never larger than the maximum angle which is determined by the highest level of vacuum produced in the diaphragm chamber 19, regardless of the enginetemperature. It is well-known that the proper angle of advance under cold operating conditions in most engines is relatively larger than the maximum angle of advance under warm operating conditions. From this point of view, the system 200 cannot be used in every kind of engine.

However, the system 200 is very simple and, thus, inexpensive, in comparison with the systems shown in FIGS. 3 through 6, and it is very useful for an engine in which the angle of advance necessary for cold operation is substantially equal to the maximum angle necessary for the warm operation.

As described above, the present invention provides novel mechanically-operated systems for realizing the proper advance of the ignition-timing under cold operating condition. Although this mechanical system is expensive, it ensures a higher level of reliability in operation, and service and maintenance thereof are easy, in comparison with conventional electrically-operated systems. The present invention also provides an additional advantage in that it is possible to combine the ignition-timing system and the fuel evaporation purge system so as to improve the cold-engine operation, as described with reference to the systems shown in FIGS. 2, 5 and 6.

The invention has been described in detail with particular reference to preferable embodiments thereof, but it will be understood that other variations and modifications can be realized within the spirit and scope of the invention.

What we claim is:

1. An ignition timing control system for an internal combustion engine comprising:

an intake tube for delivering a combustible mixture to an engine and having a vacuum port in the wall of said tube;

a throttle valve mounted in the intake tube;

an ignition timing means synchronized with the engine;

a vacuum actuator having a vacuum chamber and an actuator means connected to the ignition timing means for advancing the ignition timing of the engine in response to increasing vacuum level in the vacuum chamber;

a vacuum line connecting the vacuum chamber of said actuator to the vacuum port in the intake tube;

an air line between the vacuum chamber and the atmosphere;

first valve means in said vacuum line between the vacuum port of the intake tube and the vacuum chamber of the actuator, said first valve means being responsive to the difference in vacuum levels in the intake tube at the vacuum port and in the vacuum chamber of the actuator to open the vacuum line when the level of vacuum at the vacuum port is greater than the level of vacuum in the vacuum chamber and to close the vacuum line when the vacuum level at the vacuum port is less than the vacuum level in the vacuum chamber; and second valve means in said air line responsive to engine temperature to close the air line when the engine is colder than a predetermined temperature and to open the air line when the engine is warmer than said predetermined temperature, such that the vacuum chamber of the actuator is exposed to the greatest level of vacuum at the vacuum port under all operating load conditions during cold engine operation and to atmospheric pressure when the engine is warmed up.

2. An ignition timing control system according to claim 1 wherein said first valve means comprises a one-way valve in said vacuum line arranged to permit fluid flow from the actuator vacuum chamber side of the valve to the vacuum port side of the valve but to prevent flow in the reverse direction.

3. An ignition timing control system according to claim 1 wherein said second valve means comprises a valve having a temperature sensing element mounted in heat conductive relation to the engine for holding said valve open when the engine is warmer than said predetermined temperature and for holding said valve shut when the engine is colder than said predetermined temperature.

4. An ignition timing control system according to claim 1 wherein said vacuum port in the intake tube is located downstream relative to the position of the throttle valve in the intake tube.

5. An ignition timing control system according to claim 1 further comprising a vacuum restraining means in the vacuum line between the air line and the vacuum port for restricting the flow of air into the intake tube through the vacuum line when the second valve means is open.

6. An ignition timing control system according to claim 1 further comprising a fuel absorption canister inserted in said air line, said canister being connected to a reservoir in the engine fuel supply to serve as part of a fuel evaporation purge system.

7. An ignition timing control system according to claim 1 wherein said intake tube has a second vacuum port in the wall of said tube positioned to sample a vacuum level in the intake tube that is responsive to the throttle valve setting, and the system further comprises a second vacuum actuator having a second vacuum chamber and an actuator means connected to the ignition timing means for advancing the ignition timing of the engine in response to increasing vacuum level in the second vacuum chamber and a second vacuum line connecting the second vacuum chamber of said second actuator to the second vacuum port in the intake tube, the timing of the ignition system being determined by whichever of the first-mentioned and second vacuum actuator means is positioned for the greatest value of ignition advance.

8. An ignition timing control system according to claim 7 wherein the first-mentioned and second actuator means are connected in tandem to said ignition timing means.

* * * * *